US005455561A

United States Patent [19]

Brown

[11] Patent Number: 5,455,561

[45] Date of Patent: Oct. 3, 1995

[54] AUTOMATIC SECURITY MONITOR REPORTER

[76] Inventor: Russell R. Brown, 1034 Missouri Ave., Deer Lodge, Mont. 59722

[21] Appl. No.: 284,195

[22] Filed: Aug. 2, 1994

[51] Int. Cl.[6] ..... G08B 13/00

[52] U.S. Cl. ..... 340/541; 348/154; 348/155

[58] Field of Search ..... 340/541; 348/154, 348/155

[56] References Cited

U.S. PATENT DOCUMENTS

| | | | |
|---|---|---|---|
| 3,825,676 | 7/1974 | Ramsden | 348/155 |
| 3,828,125 | 8/1974 | Fagan | 348/155 |
| 3,932,703 | 1/1976 | Bolsey | 348/155 |
| 3,988,533 | 10/1976 | Mick | 348/155 |
| 4,160,998 | 7/1979 | Kamin | 348/155 |
| 4,288,819 | 9/1981 | Williams . | |
| 4,408,224 | 10/1983 | Yoshida | 348/155 |
| 4,651,143 | 3/1987 | Yamanaka . | |
| 5,134,472 | 7/1992 | Abe | 348/155 |
| 5,239,459 | 8/1993 | Hunt et al. . | |
| 5,253,070 | 10/1993 | Hong | 348/155 |

*Primary Examiner*—John K. Peng
*Assistant Examiner*—Albert K. Wong
*Attorney, Agent, or Firm*—Richard C. Litman

[57] ABSTRACT

A video camera surveillance system used to monitor areas, during times of inactivity, for threats to safety and security such as the presence of intruders or fire. The system detects the magnitude of the difference between a reference frame and a frame coming from a camera. The system then counts the number of frames in which the aforementioned difference is above a certain threshold, and uses that number to discriminate between nuisances and real threats to security. Once the presence of a threat to security is determined, the system activates a video cassette recorder in addition to generating an alarm. The system then turns off the recorder when the area returns to normal, thus conserving video tape.

16 Claims, 3 Drawing Sheets

AUTOMATIC SECURITY MONITOR REPORTER

BACKGROUND OF THE INVENTION

1. Field of the Invention

The present invention relates to video surveillance systems for monitoring areas during times of inactivity, for example: areas within banks, department stores, warehouses, or industrial facilities during hours when such facilities are closed. Such systems alert security personnel, and start video cassette recorders when, e.g., an intruder or a fire is detected.

2. Description of the Prior Art

In the prior art many security and intrusion detection systems based on non-video sensors, such as microwave sensors, geophones, magnetic seismic sensors, and ported coax cables, have been used to alert the appropriate authorities as to an unauthorized intrusion into an area. U.S. Pat. No. 4,651,143 issued to Yamanaka discloses a security system that uses sensors to detect intrusion. Once an intruder is detected a video recorder is activated, and a remote monitoring site is alerted.

U.S. Pat. No. 5,239,459 issued to Hunt et al. disclose a security system that requires several sensors in various zones within a structure to detect intrusion. Also, the Hunt et al. system uses adaptive learning networks to distinguish between an intrusion and a nuisance. Security systems of the type disclosed by Hunt et al. have the disadvantages of great cost and complexity, and of requiring sensors to be installed throughout a structure. For this reason there has been a trend in the art toward intrusion detection systems using video cameras. A single video camera can monitor a large area thus eliminating the need for large numbers of sensors within a structure. Further, video camera based systems can be installed at lower cost with little or no modification to the premises.

Various arrangements have been proposed for monitoring a scene using a video camera and activating various alarms and recording devices in response to any changes detected in the scene under surveillance. U.S. Pat. No. 3,825,676 issued to Ramsden, Jr. discloses a change detector circuit for detecting a change in the video signal from a video camera used as part of a surveillance system for monitoring an area to be protected. The circuit disclosed by Ramsden, Jr. comprises a signal integrator and a storage device. The video signal from the camera is sampled and the sampled signal is integrated using the integrator. The output of the integrator is temporarily stored in the storage device. The integrator is then reset to zero. The signal from the camera is again sampled and the sample integrated using the integrator. The output of the integrator is compared to the stored value, and an alarm is generated if any difference between the stored value and the most recent integrator output is detected. The value stored in the storage device is updated with the most recent integrator output and the integrator is reset to zero. This cycle is then continuously repeated for continuous operation of the change detector.

U.S. Pat. No. 3,828,125 issued to Fagan et al., discloses a surveillance system where the video signal from the camera is passed through various filters to reject portions of the video signal corresponding to large areas of uniform brightness and fine detail, such that only transitions from reasonably large objects are reflected in the filtered signal. The filtered signal is then fed to an average detector which produces an output voltage used to operate an indicator or alarm device. Fagan et al. also disclose the use of a sliding window amplifier to prevent false alarms due to slow changes in ambient lighting and rapid transient changes such as those caused by a bird flying through the monitored area. Fagan et al. also disclose the use of the alarm signal to activate a video recorder for obtaining a permanent record of the disturbances in the area under surveillance. Due to circuit noise, systems such as those disclosed in the Fagan et al. and Ramsden, Jr. patents inherently are not sensitive enough to reliably detect certain types of motion.

U.S. Pat. No. 3,932,703, issued to Bolsey, discloses a motion detector wherein the video signal is filtered to remove random high frequency noise and attenuate lower frequency portions of the video signal. The filtered signal is then fed to a flip-flop which changes the polarity of its output in response to each zero crossing in the filtered signal. The output of the flip-flop is fed to one input of a comparator gate, while a reference signal stored on a magnetic medium is fed to the other input of the comparator gate. The comparator gate output goes high if any mismatch exists between the flip-flop output and the reference signal. The output of the comparator gate is fed to an integrator which generates a greater than zero output which continuously increases as long as the comparator gate output is high. A threshold detector causes an alarm to be triggered when the output of the integrator passes a preset threshold.

The drawback of the Bolsey system is that changes in a single video frame can cause an alarm. Events in a single frame are generally too rapid to raise a security concern. In addition, because the Bolsey system relies on filtering to prevent false alarms, it is prone to false alarms under low light conditions when the signal to noise ratio is relatively low. To remedy this defect, Bolsey is forced to employ a complex scheme to prevent this type of false alarm. Bolsey uses an alarm disabling gate between the comparator and the integrator to prevent this type of false alarm. This gate is rendered conductive only if the filtered signal is above a certain threshold as determined by an additional threshold detector circuit. Thus the Bolsey system will be rendered totally inoperative when the ambient light falls below a threshold corresponding to the filtered signal threshold for rendering the alarm disabling gate conductive.

This feature also adds to the complexity of the operation of the Bolsey system, because the operator has to set the filtered signal threshold by empirically determining the level at which the filtered signal becomes masked by noise. Further, the Bolsey system prevents false alarms due to slow changes in ambient light conditions, for example, due to the setting of the sun, by making the amplitude of the filtered video signal independent of illumination. Thus the Bolsey system cannot distinguish between changes in ambient light, such as changes due to the setting of the sun, which do not require a security alert, and those, such as the blowing of a light bulb or the turning on of a light, which may require a security alert.

U.S. Pat. No. 3,988,533 issued to Mick et al. discloses a motion and intrusion detection system which digitizes the value of the video signal at discrete points within the visual field of the video camera. The values of the video signal at these same points in a subsequent frame are digitized and compared to the values from the previous frame by digitally subtracting one set of values from the other. In the system of Mick et al., the frames are compared at specific sample points. If a difference beyond a preset threshold is detected at a given sample point, then an alarm condition exists at that particular point. The system of Mick et al. keeps a count of sample points having an alarmed condition and a count of frames having an alarm condition. If a preset number of alarm conditions is received within a preset period of time, then an alarm signal is generated. The Mick et al. system has the disadvantage of requiring complex synchronization circuitry to ensure that the exact same points are sampled in each frame. Further, the Mick et al. system requires an extremely fast A/D converter which is expensive and requires sophisticated software for its operation.

None of the above inventions and patents, taken either singly or in combination, is seen to describe the instant invention as claimed.

SUMMARY OF THE INVENTION

The present invention, in its simplest form, is a video surveillance system made up of the following component parts:

(a) at least one video camera;

(b) circuitry for generating an analog difference signal between a stored reference video frame and video frames coming from the video camera;

(c) circuitry for discriminating between signals due to nuisance sources, such as animal intrusions or changes in ambient lighting conditions, and signals due to security compromising events such as unauthorized human intrusion or fire; and (d) circuitry for generating an alarm and/or turning on a video cassette recorder.

Accordingly, it is a principal object of the invention to provide a video surveillance system wherein a change in the scene under surveillance is used to trigger an alarm, turn on a video cassette recorder, alert police, etc.

It is another object of the invention to reduce false alarms by providing a video surveillance system with the capability to discriminate between signals due to nuisance sources, such as animal intrusions or changes in ambient lighting conditions, and signals due to security compromising events such as unauthorized human intrusion or fire.

It is a further object of the invention to eliminate the need for complex circuitry for processing the video signal before comparing the video signal to a stored signal corresponding to a reference video frame.

Still another object of the invention is to provide a video surveillance system with sufficient sensitivity to reliably detect most types of motion having security implications.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a video surveillance system for monitoring an area during times of inactivity. During such times the area or scene, as viewed through a video camera, is not expected to change. Therefore, ordinarily the images or frames sent by the video camera should not change over time. However, not all changes between frames warrant a response from security personnel. The present invention uses the size of the change between frames and the duration of the change to discriminate between nuisance changes and those changes that represent a breach of safety or security. The size of the change is determined by the magnitude of the difference between the frames coming from the camera in real time and a stored frame representing the scene as it should look in the absence of any breach in safety or security. The duration of the change is determined by counting the number of frames in which the change persists.

Figure 1:
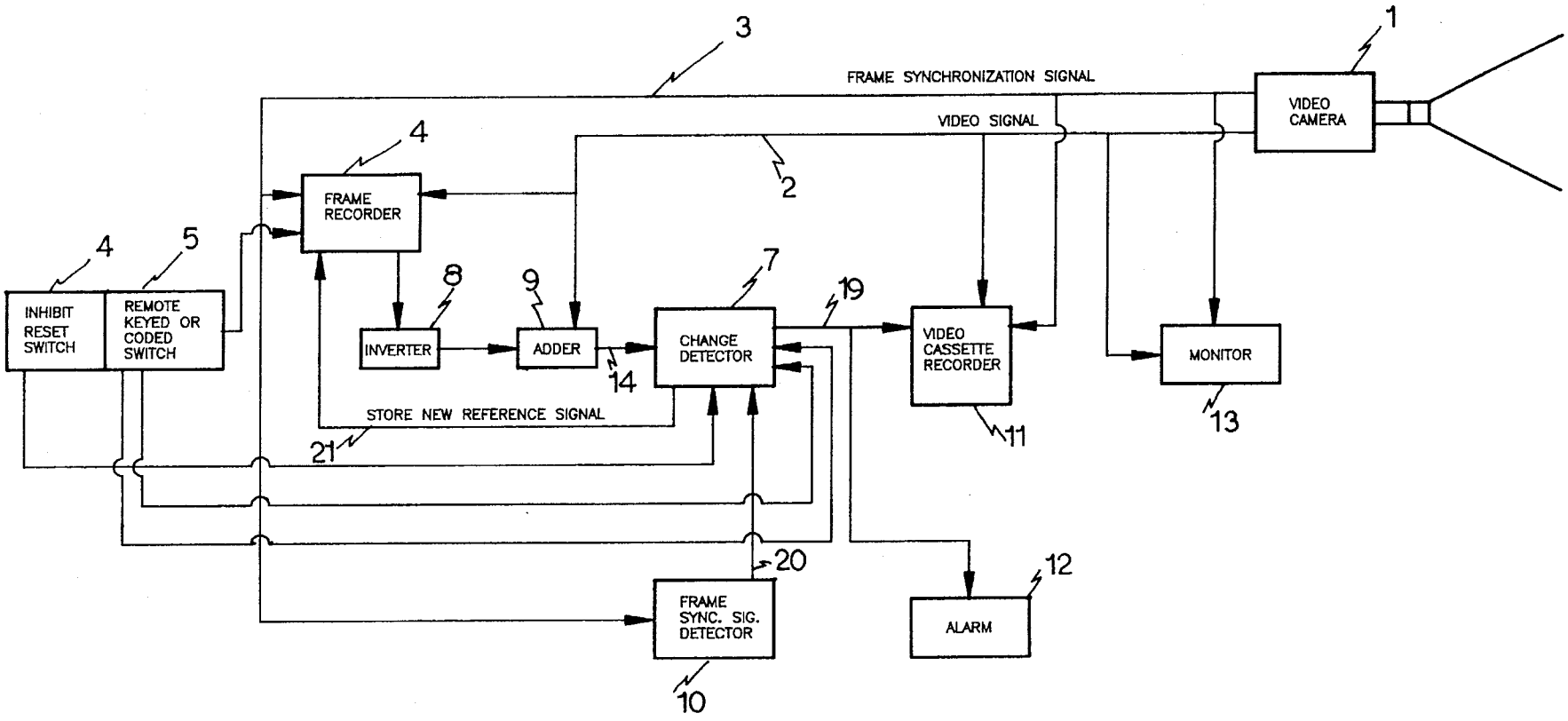
FIG. 1 is a block diagram of the overall video surveillance system embodying the present invention.
Figure 2:
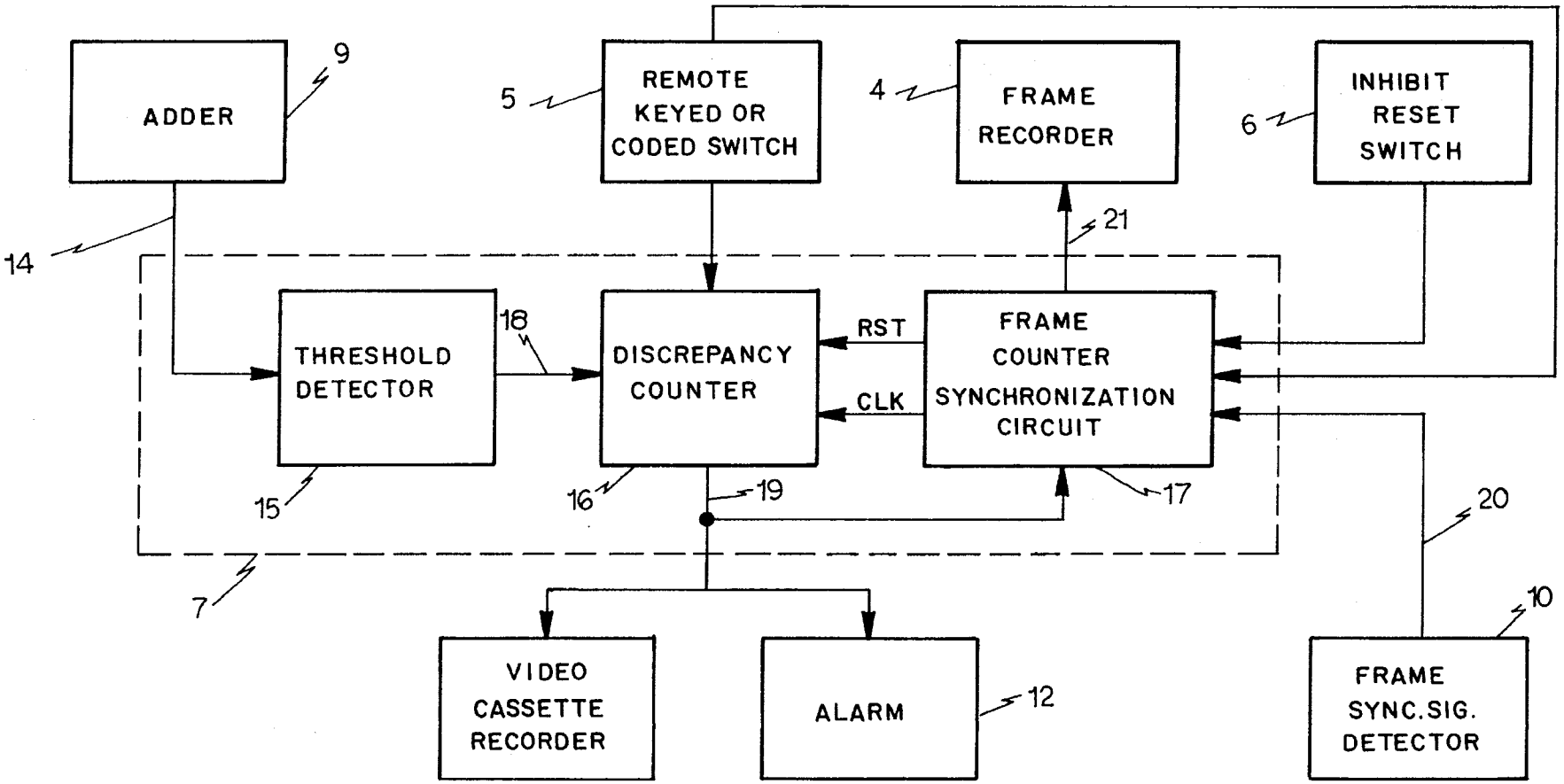
FIG. 2 is a block diagram showing the change detector in greater detail.

Referring to FIGS. 1 and 2, a video camera 1 is used to monitor a scene during a period of inactivity, such as a store or warehouse at night. The output of the video camera normally includes a video signal 2, and a frame synchronization signal 3 (also known as vertical sync.). The frame synchronization signal is a periodic signal that is synchronized with the video signal, and determines the portion of the video signal that corresponds to a single frame of video. Therefore, the frame synchronization signal determines the rate and the time at which frames of video leave the video camera 1. A frame is the portion of the video signal 2 corresponding to one video screen image of the scene being monitored.

Both the video signal 2 and the frame synchronization signal 3 are fed to the frame recorder 4. The frame recorder 4 is of a type well known in the art, and can store one frame of video. To initiate the monitoring of an area, the person operating the security system uses the remote keyed or coded switch 5 to cause a frame to be stored in the frame recorder 4 at, for example, the beginning of the period of inactivity in the premises being monitored. This stored frame will act as a reference frame for comparison with subsequent frames outputted by the camera 1. The subsequent frame outputted from the video camera 1 is fed to adder 9. Meanwhile, the frame stored in frame recorder 4 is fed to inverter 8 where the stored frame is inverted. The inverted reference frame is then fed to adder 9 simultaneously with the frame outputted from camera 1 subsequent to the reference frame. The inverted reference frame and the subsequently outputted frame are then added together in the adder and an analog difference signal 14 is generated.

The analog difference signal 14 is then fed to change detector 7. The change detector 7 is made up of a threshold detector 15, a discrepancy counter 16, and a frame counter synchronization circuit 17. The analog difference signal 14 is fed to the threshold detector 15. If the magnitude of the analog difference signal 14 exceeds a preset threshold value within the threshold detector 15, the output signal from the threshold detector 18 changes state, i.e. it is set. The magnitude of the analog difference signal 14 corresponds to the size of an object appearing in the scene being monitored. The threshold value is dictated by the size of the smallest object that would raise a security concern. In the usual case such an object would be the size of a human intruder. If desired, provision can be made within the control panel (not shown) housing the remote keyed or coded switch 5, for the operator to set the threshold value within the threshold detector 15.

Once the threshold detector output 18 is set, the discrepancy counter 16 is enabled and begins to count the clock cycles appearing in the frame rate clock signal (CLK). The CLK signal has a clock rate equivalent to the rate at which frames are outputted from the camera 1. Therefore, the count value in discrepancy counter 16, herein referred to as discrepancy count value, represents the number of frames having a discrepancy or difference from the reference frame which is beyond the threshold value in the threshold detector. The discrepancy count value is proportional to the duration of the presence of the object raising a security concern in the scene being monitored. If the object is present in only a few frames, then the duration of the objects presence will be too short to be attributable to, for example, a human intruder. If however, the discrepancy which is beyond the threshold value lasts more than a certain minimum number of frames, then the above threshold discrepancy may be due to a human intruder, e.g.. Therefore the remote keyed or coded switch 5 also has provision for allowing the operator to program the discrepancy counter 16 with a minimum discrepancy count value. If the discrepancy count value exceeds the minimum, then an alarm signal is generated on signal line 19.

In order to avoid false alarms due to slow changes in ambient conditions such as the sun rising, it is necessary to update the reference frame before the cumulative effect of the slow, small changes in ambient conditions, exceeds the threshold in threshold detector 15. For this purpose the frame counter synchronization circuit 17 is provided. The frame counter synchronization circuit 17 receives an input from the frame synchronization signal detector 10. The frame synchronization signal detector 10 receives as input the frame synchronization signal from the video camera 1. The output of the frame synchronization signal detector 10 is a clock signal 20 having a clock rate identical to the rate at which frames are outputted from the video camera 1. The frame counter synchronization circuit 17 uses the clock signal 20 to keep a count of the frames outputted by camera 1. To ensure that false alarms due to slow environmental changes are prevented, while allowing sufficient time for the detection of changes in the scene being monitored that are due to breaches in safety or security, it is sufficient to update the reference frame at time intervals on the order of several to tens of seconds. The time interval between updates of the reference frame corresponds to a certain number of frames which will henceforth be referred to as the maximum frame count. Again the keyed or coded switch 5 makes provision for the operator to program the frame counter synchronization circuit 17 with the maximum frame count. In the absence of an alarm condition on signal line 19, each time the count of frames kept by the frame counter synchronization circuit 17 reaches the maximum frame count, a discrepancy counter reset signal (RST) and a signal 21 to the frame recorder 4 to store a new reference frame are generated by the frame counter synchronization circuit 17.

When an alarm condition appears on signal line 19, that alarm condition is routed to the frame counter synchronization circuit 17, in addition to the video cassette recorder 11 and the alarm 12. The appearance of an alarm condition on signal line 19 inhibits the frame counter synchronization circuit 17 from generating the signal 21. Thus the storing of a new reference frame by the frame recorder 4 is prevented. However, the RST signal is still generated each time the count of frames kept by the frame counter synchronization circuit 17 reaches the maximum frame count. The alarm condition on signal line 19 also activates video cassette recorder 11 and the alarm 12. The alarm 12 generally is in the form of an alarm bell, but in addition or as an alternative may include any combination of alerting the police, activating a speaker, accessing a telephone, activating remote monitors and/or video cassette recorders, and alerting other security personnel.

As long as the monitored scene remains changed to a degree beyond the threshold set in threshold detector 15, the alarm condition is maintained, the updating of the reference frame is inhibited, and the video cassette recorder records all activity in the monitored scene.

Once the scene returns to normal the analog difference signal 14 falls below the threshold value in threshold detector 15, the threshold detector output 18 is reset and the discrepancy count value in the discrepancy counter 16 is no longer incremented. The next time the count of frames kept by the frame counter synchronization circuit 17 reaches the maximum frame count, an RST signal is generated by the frame counter synchronization circuit 17 resetting the discrepancy count value in the discrepancy counter 16. Since the discrepancy count value is now below the minimum required to generate an alarm condition, the alarm condition is removed from alarm signal line 19. The removal of the alarm condition from alarm signal line 19 causes the turning off of the video cassette recorder 11. This results in saving video tape since the recorder is no longer recording images of the monitored scene when no significant changes are taking place.

In the case where the scene is permanently changed, the person investigating the alarm will reset the system using the inhibit reset switch 6. Activating the inhibit reset switch 6 causes the frame counter synchronization circuit 17 to generate a signal 21 to the frame recorder 4 to store a new reference frame. Since the frames outputted by the camera 1 are no longer significantly different from the stored reference frame, the analog difference signal 14 falls below the threshold value in threshold detector 15. As in the case of the scene returning to normal, the threshold detector output 18 is reset and the discrepancy count value in the discrepancy counter 16 is no longer incremented. The next time the count of frames kept by the frame counter synchronization circuit 17 reaches the maximum frame count, an RST signal is generated by the frame counter synchronization circuit 17 resetting the discrepancy count value in the discrepancy counter 16. Since the discrepancy count value is now below the minimum required to generate an alarm condition, the alarm condition is removed from alarm signal line 19.

The remote keyed or coded switch 5 and the inhibit reset switch 6 are normally contained in a control panel near an exit from the premises being monitored. The control panel also will house any additional input devices that may be necessary to program the video surveillance system of the present invention with all the necessary parameters. A video monitor 13 is also normally provided at the site under surveillance to display the output from video camera 1.

The assemblage of the circuits represented by the various blocks in the block diagrams depicted in FIGS. 1 and 2, can be accomplished using readily available components.

Figure 3:
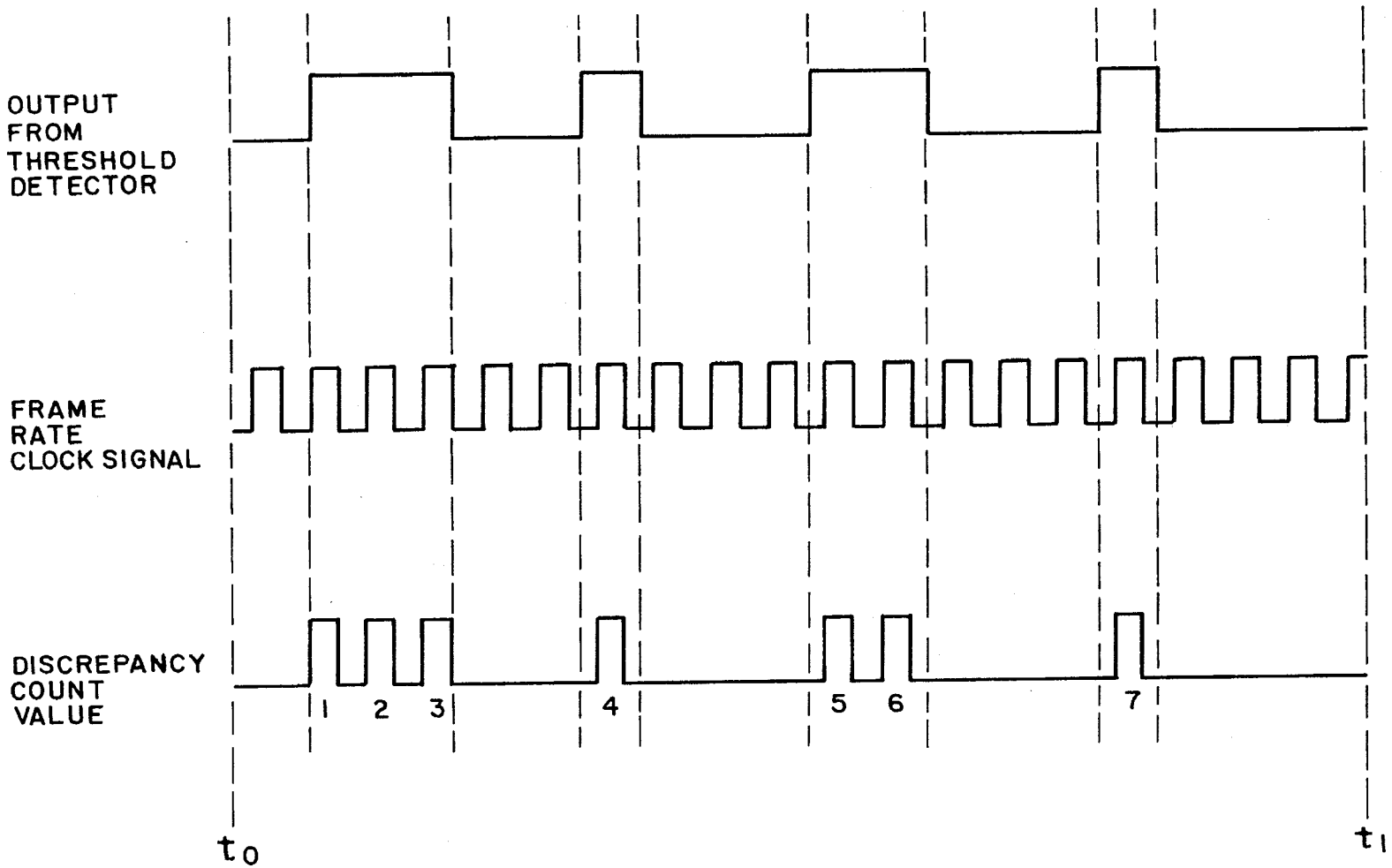
FIG. 3 is a timing diagram showing the relationship between the frame rate clock (CLK) signal, the threshold detector output, and the discrepancy count value stored in the discrepancy counter.

FIG. 3 shows the timing relationship between the discrepancy count value in discrepancy counter 16, the frame rate clock signal (CLK), and the threshold detector output 18. The time interval between $t_0$ and $t_1$ is equivalent to the time required for the camera 1 to output a number of frames equal to the maximum frame count. As can be seen from FIG. 3, each time the threshold detector output goes high, the discrepancy count value is incremented once for every clock cycle in the CLK signal. The discrepancy count value is not incremented during times when the threshold detector output is low. In the example shown, the discrepancy count value would be seven before the reference frame would ordinarily be updated. If the minimum value required to trigger an alarm is less than seven, then in this example an alarm signal would have been generated.

Although the invention has been described with reference to a video camera, it is to be understood that the present invention can be used with other types of detectors such as microwave scanners and thermal imaging devices, that can produce an electronic depiction of an area under surveillance. In addition, recorders, other than a video cassette recorder, may be used which are compatible with the particular type of detector being used.

It is to be understood that the present invention is not limited to the sole embodiment described above, but encompasses any and all embodiments within the scope of the following claims.

I claim:

1. A surveillance system for keeping an area under surveillance for detecting breaches of safety and security, comprising:

a video camera, said video camera being capable of producing an electronic depiction of the area under surveillance, said electronic depiction being in the form of a series of frames transmitted over time;

a frame recorder electronically connected to said video camera to receive said series of frames transmitted from said video camera, said frame recorder storing at least one frame from said series of frames as a reference frame;

means for generating an analog difference signal between said reference frame and at least one subsequent frame from said series of frames; and a change detector for determining the number of frames in said series of frames in which said analog difference signal exceeds a preset threshold during a preprogrammed time interval immediately following the storing of said reference frame, said change detector generating an alarm condition when said number of frames exceeds a preprogrammed value, and said change detector generating a signal to store a new reference frame in said frame recorder when said number of frames does not exceed said preprogrammed value.

2. The surveillance system according to claim 1, further comprising a video cassette recorder which is activated in response to said alarm condition.

3. The surveillance system according to claim 2, wherein means are provided for the alarm condition to initiate an action selected from the group consisting of activating an alarm, alerting the police, activating a speaker, accessing a telephone, activating remote monitors, activating remote video cassette recorders, and alerting other security personnel.

4. The surveillance system according to claim 2, wherein means are provided for turning off the video cassette recorder when said analog difference signal falls below said preset threshold.

5. A surveillance system according to claim 1, wherein said change detector comprises:

a threshold detector, having and input and an output, said input of said threshold detector being said analog difference signal, and said output of said threshold detector going high if said difference signal between a frame from said series of frames subsequent to said reference frame and said reference frame is beyond a preset threshold;

a discrepancy counter, said discrepancy counter maintaining a first count of frames from said series of frames that are transmitted while the output from said threshold detector is high, said discrepancy counter generating an alarm condition if said first count exceeds a first preprogrammed value; and a frame counter synchronization circuit, said frame counter synchronization circuit maintaining a second count of frames from said series of frames that are transmitted immediately subsequent to said reference frame, said frame counter synchronization circuit generating a signal to reset said first count when said second count reaches a second preprogrammed value, and said frame counter synchronization circuit generating a signal to store a new reference frame in said frame recorder when said second count reaches said second preprogrammed value and said alarm condition has not been generated.

6. The surveillance system according to claim 5, further comprising a video cassette recorder which is activated in response to said alarm condition.

7. The surveillance system according to claim 6, wherein means are provided for the alarm condition to initiate an action selected from the group consisting of activating an alarm, alerting the police, activating a speaker, accessing a telephone, activating remote monitors, activating remote video cassette recorders, and alerting other security personnel.

8. The surveillance system according to claim 6, wherein means are provided for turning off the video cassette recorder when said analog difference signal falls below said preset threshold.

9. A surveillance system for keeping an area under surveillance for detecting breaches of safety and security, comprising:

a video camera, said video camera being capable of producing an electronic depiction of the area under surveillance, said electronic depiction being in the form of a series of frames transmitted over time;

a frame recorder electronically connected to said video camera to receive said series of frames transmitted from said video camera, said frame recorder storing at least one frame from said series of frames as a reference frame;

an inverter for inverting said reference frame to generate an inverted reference frame;

and adder for adding a frame in said series of frames transmitted subsequent to said reference frame to said inverted reference frame to generate an analog difference signal; and a change detector for determining the number of frames in said series of frames in which said analog difference signal exceeds a preset threshold during a preprogrammed time interval immediately following the storing of said reference frame, said change detector generating an alarm condition when said number of frames exceeds a preprogrammed value, and said change detector generating a signal to store a new reference frame in said frame recorder when said number of frames does not exceed said preprogrammed value.

10. The surveillance system according to claim 9, further comprising a video cassette recorder which is activated in response to said alarm condition.

11. The surveillance system according to claim 10, wherein means are provided for the alarm condition to initiate an action selected from the group consisting of activating an alarm, alerting the police, activating a speaker, accessing a telephone, activating remote monitors, activating remote video cassette recorders, and alerting other security personnel.

12. The surveillance system according to claim 10, wherein means are provided for turning off the video cassette recorder when said analog difference signal falls below said preset threshold

13. The surveillance system according to claim 12, further comprising a video cassette recorder which is activated in response to said alarm condition.

14. A surveillance system for keeping an area under surveillance for detecting breaches of safety and security, comprising:

a video camera, said video camera being capable of producing an electronic depiction of the area under surveillance, said electronic depiction being in the form of a series of frames transmitted over time;

a frame recorder, electronically connected to said video camera to receive said series of frames transmitted from said video camera, said frame recorder storing at least one frame from said series of frames as a reference frame;

an inverter for inverting said reference frame to generate an inverted reference frame;

and adder for adding a frame in said series of frames transmitted subsequent to said reference frame, to said inverted reference frame to generate an analog difference signal; and a threshold detector, having and input and an output, said input of said threshold detector being said analog difference signal, and said output of said threshold detector going high if said difference signal between a frame from said series of frames subsequent to said reference frame and said reference frame is beyond a preset threshold;

a discrepancy counter, said discrepancy counter maintaining a first count of frames from said series of frames that are transmitted while the output from said threshold detector is high, said discrepancy counter generating an alarm condition if said first count exceeds a first preprogrammed value; and a frame counter synchronization circuit, said frame counter synchronization circuit maintaining a second count of frames from said series of frames that are transmitted immediately subsequent to said reference frame, said frame counter synchronization circuit generating a signal to reset said first count when said second count reaches a second preprogrammed value, and said frame counter synchronization circuit generating a signal to store a new reference frame in said frame recorder when said second count reaches said second preprogrammed value and said alarm condition has not been generated.

15. The surveillance system according to claim 13, wherein means are provided for the alarm condition to initiate an action selected from the group consisting of activating an alarm, alerting the police, activating a speaker, accessing a telephone, activating remote monitors, activating remote video cassette recorders, and alerting other security personnel.

16. The surveillance system according to claim 13, wherein means are provided for turning off the video cassette recorder when said analog difference signal falls below said preset threshold.

* * * * *